United States Patent [19]

Ahmann

[11] Patent Number: 4,981,259

[45] Date of Patent: Jan. 1, 1991

[54] BALLOT BOX

[76] Inventor: John E. Ahmann, 1400 Duhig Rd., Napa, Calif. 94558

[21] Appl. No.: 264,640

[22] Filed: Oct. 31, 1988

[51] Int. Cl.[5] ..... G07C 13/02

[52] U.S. Cl. ..... 232/2; 235/56; 235/57

[58] Field of Search ..... 232/2; 235/56, 57

[56] References Cited

U.S. PATENT DOCUMENTS

| | | | |
|---|---|---|---|
| 1,275,579 | 8/1918 | McGowan | 232/2 |
| 3,441,714 | 4/1969 | Simjian | 235/56 X |
| 3,682,375 | 8/1972 | Partovi-Najafabadi | 235/57 X |
| 3,733,469 | 5/1973 | Meyer | 235/56 X |

*Primary Examiner*—Robert W. Gibson, Jr.
*Attorney, Agent, or Firm*—Owen, Wickersham & Erickson

[57] ABSTRACT

A ballot box is disclosed for use in combination with an electronic voter ballot tabulating device which accepts marked paper ballots, tabulates the voter selection thereon and dispenses the tabulated ballots through one of a plurality of exit openings in its bottom side. The ballot box comprises an enclosure having side walls, end walls, a bottom member and a top member having at least one pair of parallel, space apart elongated openings that are aligned with the exit openings of the tabulated device. Within the enclosure, partitions are provided for forming separate storage chambers beneath each of the elongated openings for receiving tabulated ballots of different categories. Access to the enclosure is provided for retrieving ballots connected in the storage chambers. A special compartment with an inlet slot is provided for receiving and storing marked ballots temporarily when the tabulating device is inoperative. Access to all chambers can be locked and contacts to the ballot box are provided to assure grounding or dissipation of static electricity which could otherwise affect the tabulating device.

15 Claims, 5 Drawing Sheets

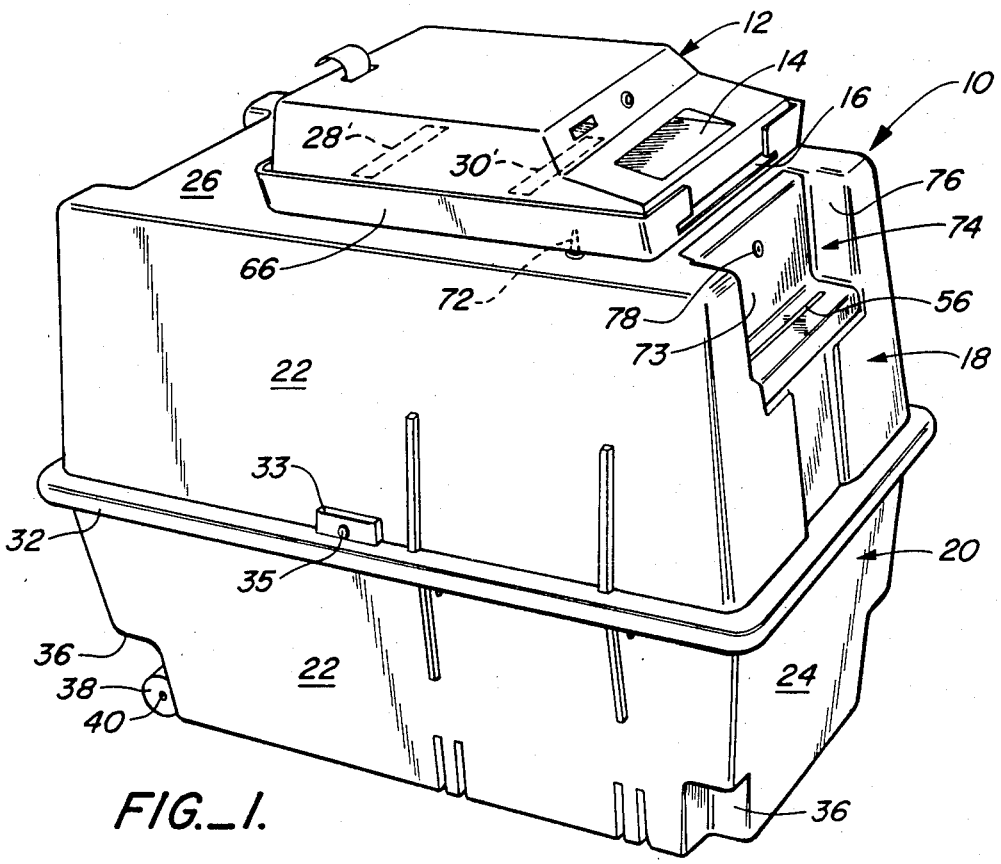
FIG._1.
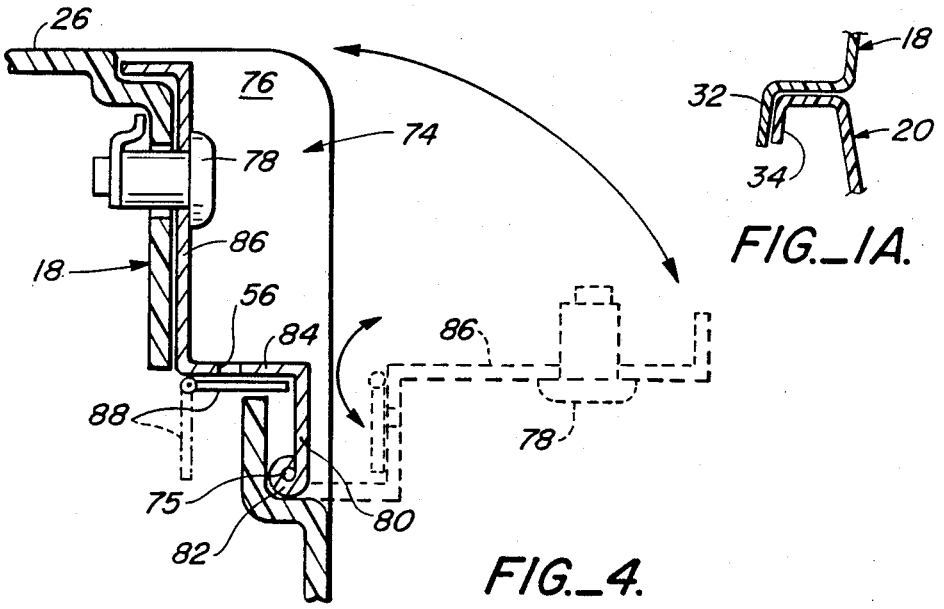
FIG._1A.
FIG._4.

69
68
70
73
66
28
30
64
4
72
78
56
73
22
4
33
24
32
18
35
20
50
62
34
60
62
58
58
24
36
42
41
46
60
44
48
22
36
38
52
40
54
24
36

FIG._6A
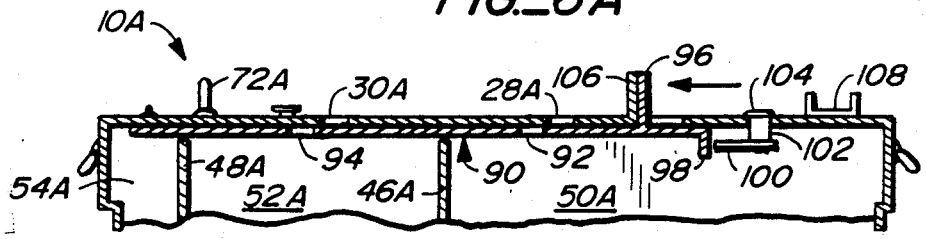
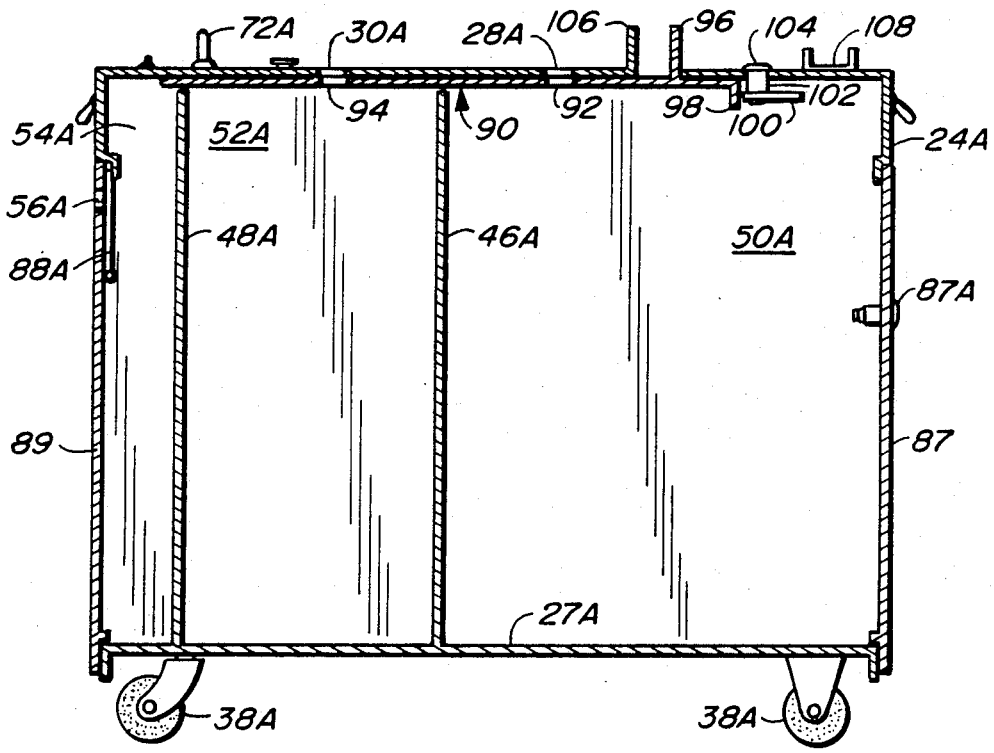
FIG._6

BALLOT BOX

This invention relates generally to voting apparatus and more particularly to a ballot box for use with a computerized ballot tabulating machine.

BACKGROUND OF THE INVENTION

The procedure and apparatus for casting and tabulating votes in an election have undergone an evolution in most communities over the years. A more recent development which is expected to be widely adopted involves the use of an electronic ballot tabulator whose size is roughly close to that of a standard typewriter. Such a vote tabulator, known as the Optech III, is manufactured by Business Records Corporation, the assignee of the present invention. In general, this tabulator accepts printed ballots that have been marked by the voter, through an inlet slot. It then automatically tabulates the voter's selections within the machine and then ejects the ballot through one of two exit openings in its bottom side. For example, ballots of one category such as write-in or absentee ballots may be ejected through one slot and regular ballots may be ejected through the other slot. Initially, the ejected ballots were collected in cardboard boxes or other makeshift containers. However, in most jurisdictions, regulations were promulgated which required that all ballots be retained in secure containers. Therefore, it was required that voting jurisdictions provide ballot boxes that could collect tabulated ballots of different categories directly from the tabulator machine and maintain them in secure chambers Moreover, it was necessary to provide such ballot boxes that could be easily transportable and also easily storable when not in use.

It is therefore a general object of the present invention to provide a ballot box for use with an automatic ballot tabulator or processor that will receive the ballots directly from the tabulator machine and retain them in separate, secure compartments after they have been processed.

Another object of the invention is to provide a ballot box which has a separate compartment that may become accessible to receive ballots temporarily if, for some reason the tabulator machine becomes inoperative.

Another object of the invention is to provide a ballot box that provides a base support for the tabulator machine and is easily movable to different locations.

Other objects of the invention are to provide a ballot box that can be disassembled and nested for storage and also one which is particularly well adapted for ease and economy of manufacture.

SUMMARY OF THE INVENTION

In accordance with the principles of the invention a ballot box is provided which in one form comprises connectable upper and lower housing sections, and a pair of internal dividers for forming interior receptacle chambers. When not in use, the ballot box may be conveniently stored in a minimum of space by nesting the housing sections, folding the dividers and placing them within the nested sections. In use, the housing sections fit together to form a secure enclosure with a pair of spaced apart slotted openings on its upper side which are adapted to receive processed ballots from the tabulation machine which is positioned on top of the enclosure. Within the enclosure, the dividers fit within guide means to form three compartments for accumulating processed ballots that pass through the upper slotted openings. A third access slot is provided at one end of the ballot box and has a controllable flap which can be adjusted to place it in the open or closed position Normally, the third access slot is closed, but if for some reason, the tabulation machine becomes inoperative, the controllable flap can be moved to the open position so that ballots can be inserted through the third slot and stored temporarily in one compartment of the enclosure. Locks are provided on the enclosure so that access to interior compartments of the enclosure to retrieve accumulated ballots can be controlled.

A second embodiment of the invention comprises a metal enclosure also having a top side adapted to support a ballot tabulator machine with slotted openings aligned with the exit openings in the machine. Fixed partitions within the enclosure form separate compartments for receiving ballots from the tabulating machine and access doors to the compartments with locks are provided on the sides of the enclosure. Both embodiments of the ballot box are provided with wheels to facilitate its easy transport from one location to another.

Other objects, advantages and features of the invention will become apparent form the following description of the embodiment thereof taken in conjunction with the accompanying drawing.

BRIEF DESCRIPTION OF DRAWING

FIG. 1 is a view in perspective of a ballot box embodying principles of the present invention.

FIG. 1A is an enlarged view in section taken along line 1A—1A of FIG. 1.

FIG. 4 is an enlarged view in section taken along line 4—4 of FIG. 2.

FIG. 6 is a view in side elevation and in section of the ballot box of FIG. 5.

FIG. 6A is a fragmentary view in section of the ballot box of FIG. 6 showing the ballot receiving slots closed.

DETAILED DESCRIPTION OF EMBODIMENT

Figure 2:
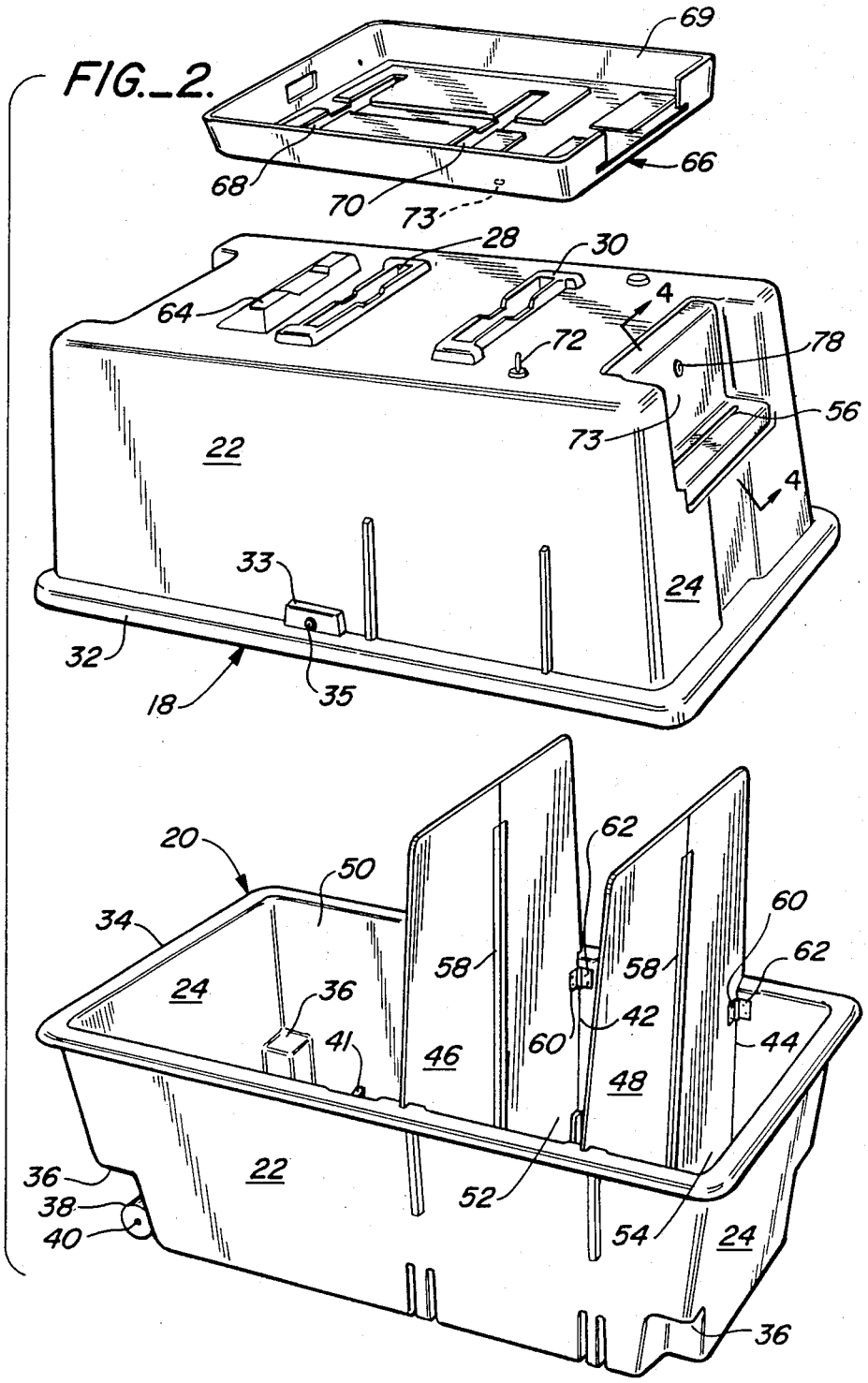
FIG. 2 is an exploded view in perspective of the ballot box of FIG. 1.

With reference to the drawing, FIG. 1 shows a ballot box 10 according to the present invention as it appears when in use in combination with a ballot tabulating machine 12, of a type that is commercially available. Such a machine will accept paper ballot sheets that have been marked by the voter, through an inlet 14 and by means of electronic optical scan elements and circuitry (not shown), it will automatically tabulate the voter's selections and provide an alpha-numeric printout of accumulated election results Blank, write-in and overvoted ballots are automatically separated. Blank and overvoted ballots are automatically returned through a slot 16 near the front of the machine 12. Normal ballots and write-in ballots are identified electronically within the machine and are automatically directed through one of two exit slots 28 and 30 in the bottom of the machine designated for each of the aforesaid categories (or for other general categories of ballots that the machine may be set for).

Figure 3:
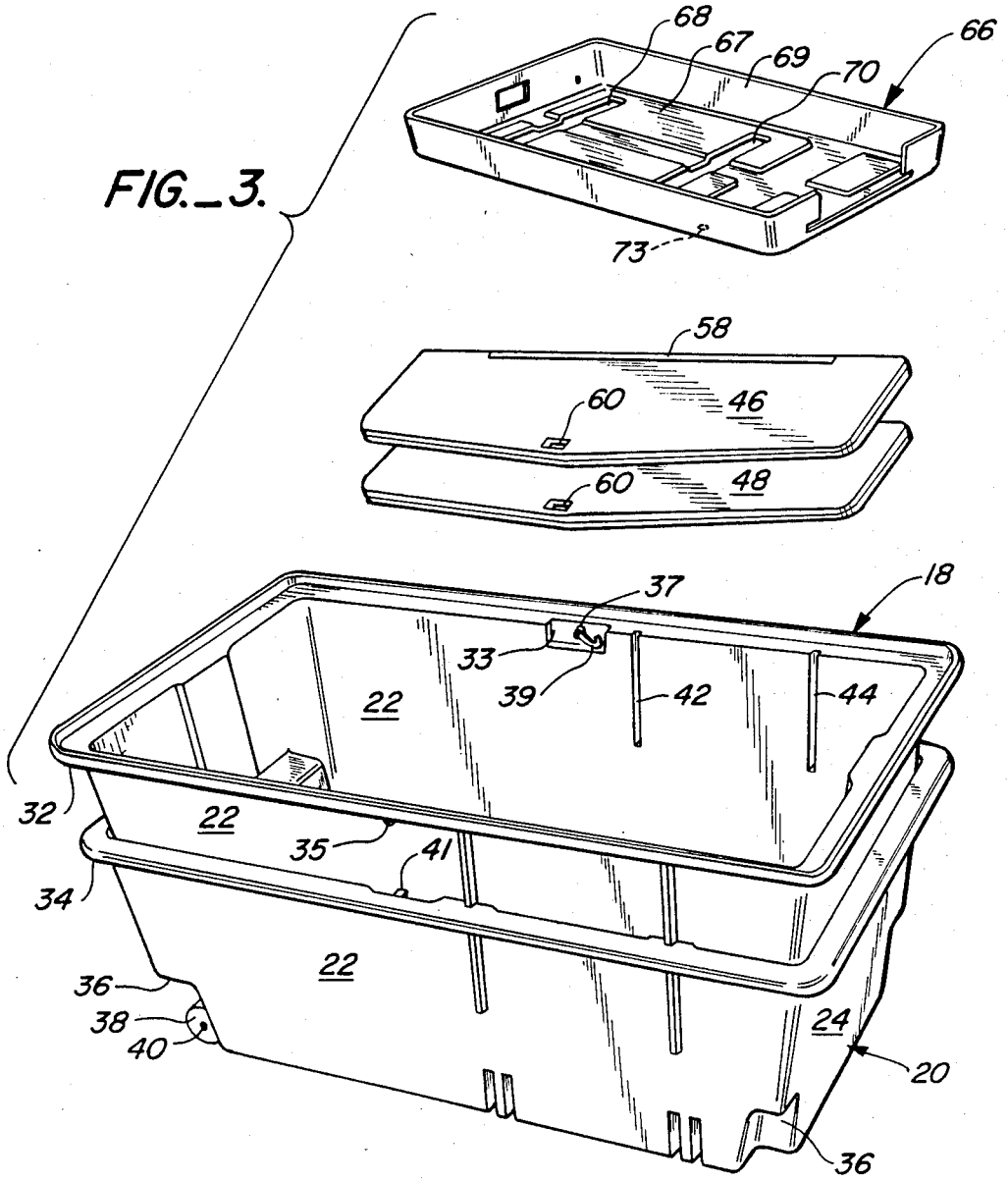
FIG. 3 is an exploded view of the ballot box of FIG. 1 showing its housing sections nested and partitions folded for storage.

The ballot box 10 supports the tabulating machine 12 and is comprised of upper and lower housing sections 18 and 20 that fit together to form an enclosure. As shown in FIGS. 2 and 3, each housing section has side walls 22 and integral end walls 24 that are slightly sloped so that the two sections will nest together when not assembled. The upper housing section 18 has a top panel 26 that connects the side walls and end walls, and formed within this top panel are two elongated, parallel and spaced apart openings 28 and 30 which substantially match the size and spacing of the exit slots in the tabulating machine 12.

Around the open periphery of the upper housing section 18 is a continuous integral edge flange 32 having generally a right angle cross section, as shown in FIG. 1A. A similar edge flange 34 is provided around the upper open end of the lower housing section 20. Thus, when the two housing sections are placed together to form an enclosure or ballot box, the edge flange 32, which is slightly larger, fits over the flange 34.

On opposite sides of the upper housing section are a pair of rectangular shaped bases 33 which provide support for a pair of key operated locks 35 which control a latch means for securing the upper and lower housing sections together As shown in FIG. 3, each lock 35 has a rotatable cylinder 37 which extends inside the upper housing and has a radially extending hook member 39 attached near its inner end. When the cylinder and thus the hook member are rotated by a key in the lock, the hook member engages a static pin 41 fixed to the inside of the lower housing section. Thus, the two housing sections can be locked before a voting process commences and can be kept locked until subsequent disposition of the ballots is accomplished in accordance with prescribed voting regulations.

Both housing sections 18 and 20 are preferably formed from a strong, durable molded plastic material such as ABS material. At the four corners of the lower housing section are provided indented recesses 36 within two of which at one end of the housing section 20 is a wheel 38 whose axle 40 is anchored in a sidewall of a recess 36. These wheels are large enough to extend just below the lower housing section 20 and thereby enable to be easily rolled from one location to another when necessary.

Figure 2A:
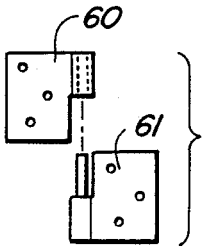
FIG. 2A is an enlarged exploded view showing the edge connectors for the foldable dividers used in the ballot box of FIG. 1.

At spaced apart locations in the side walls 22 of the lower housing section 20 are two pairs of grooves 42 and 44 which are formed during the molding process These grooves are adapted to receive and retain a pair of dividers 46 and 48. As shown in FIG. 2, when the divider 46 is inserted in an upright position with its opposite edge portions in the grooves 42 and similarly, the divider 48 is retained within the grooves 44, three compartments or chambers 50, 52, and 54 are formed within the lower housing section. The compartment 50 formed between are divider 46 and an end wall 24 of the lower housing forms is relatively large and is located beneath the slotted opening 28 in the upper housing when the ballot box is assembled. The next, somewhat smaller compartment 52, formed between the two dividers 46 and 48 is located beneath the slotted opening 30. The third and smallest compartment 54 is located between the divider 48 and the other end wall of the lower housing 20 and is accessible via another auxiliary opening 56 in the upper housing, which will be described below. The dividers 46 and 48 are each preferably made of a suitable rigid sheet material which may be wood, plastic or pressed fibre material. Each divider is made in two similar sections which are connected by a hinge 58 along the divider centerline. To further stabilize the dividers when they are placed in their retaining grooves, each one may be provided with a pair of suitable connectors 60 at spaced apart locations along their opposite edges. As shown in FIG. 2A, these connectors each have an elongated opening which is adapted to receive a projecting pin of a mating connector 62 that is fixed to the inner surface of the lower housing side walls.

On the upper housing 18, the top panel 26 is provided with a transverse stop member 64 that projects above its surface and serves to position the tabulating machine 12. The lower portion of the tabulating machine comprises a lower tray member 66 formed from molded plastic material, and having a generally rectangular shape with a planar bottom 67 and a surrounding wall member 69 on its four sides. This tray member accommodates the upper portion of the tabulating machine and has a pair of elongated openings 68 and 70 which are sized and spaced apart to coincide with the openings 28 and 30 of the upper housing 18. A fixed stud member 72 is anchored in the top panel 26 of the upper housing member near its front end and to one side. This stud member fits through a hole in the bottom 68 of the ballot tabulator to hold it firmly in place on the ballot box and against the upper surface of the top panel 26.

At the front end of the upper housing section 18 as shown in FIG. 1, is an indentation 74 for a movable door 73 that provides access to the third compartment 54. This third compartment is provided to serve as a temporary storage place for ballots when the tabulating machine 12, for some reason, is temporarily inoperative. The door 73 is provided with the auxiliary slotted opening 56 and is mounted for rotation about an elongated hinge pin 75, as shown in detail in FIG. 4. The hinge pin 75 is anchored at opposite ends in the walls 76 of the indentation 74. A suitable lock 78 for the door 73 is provided to retain it in the closed position. In cross section, as indicated in FIG. 4, the door has a lower vertical panel 80 with a sleeve portion 82 at its lower edge which fits around the pin 75. The panel 80 is connected at its upper edge to a generally horizontal panel 84 that has the auxiliary opening 56. At its other edge the panel 84 is connected to a larger vertical panel 86 that supports the lock 78 and fits flush against a vertical portion of the upper housing 18. Attached to the inner surface of the horizontal panel 84 of the door 73 is a pivotal flap member 88. When the tabulating machine 12 is operating normally it is usually desired that the auxiliary opening 56 be closed. Thus, the flap member 88 can be pivoted upward to cover the opening 56 and is held in this closing position when the door 72 to the third compartment 54 is closed. If the tabulating machine 12 becomes inoperative and ballots need to be temporarily stored in the third compartment, the door 72 can be opened to allow the flap member 88 to pivot downwardly and thereby leave the opening 56 unobstructed When not in use, the ballot box 10 can be disassembled with upper and lower housing sections nested as shown in FIG. 3. The dividers 46 and 48 may be removed, folded and placed within the nested housing sections In this way several ballot boxes 10 can be stacked and stored in a relatively small area.

Figure 5:
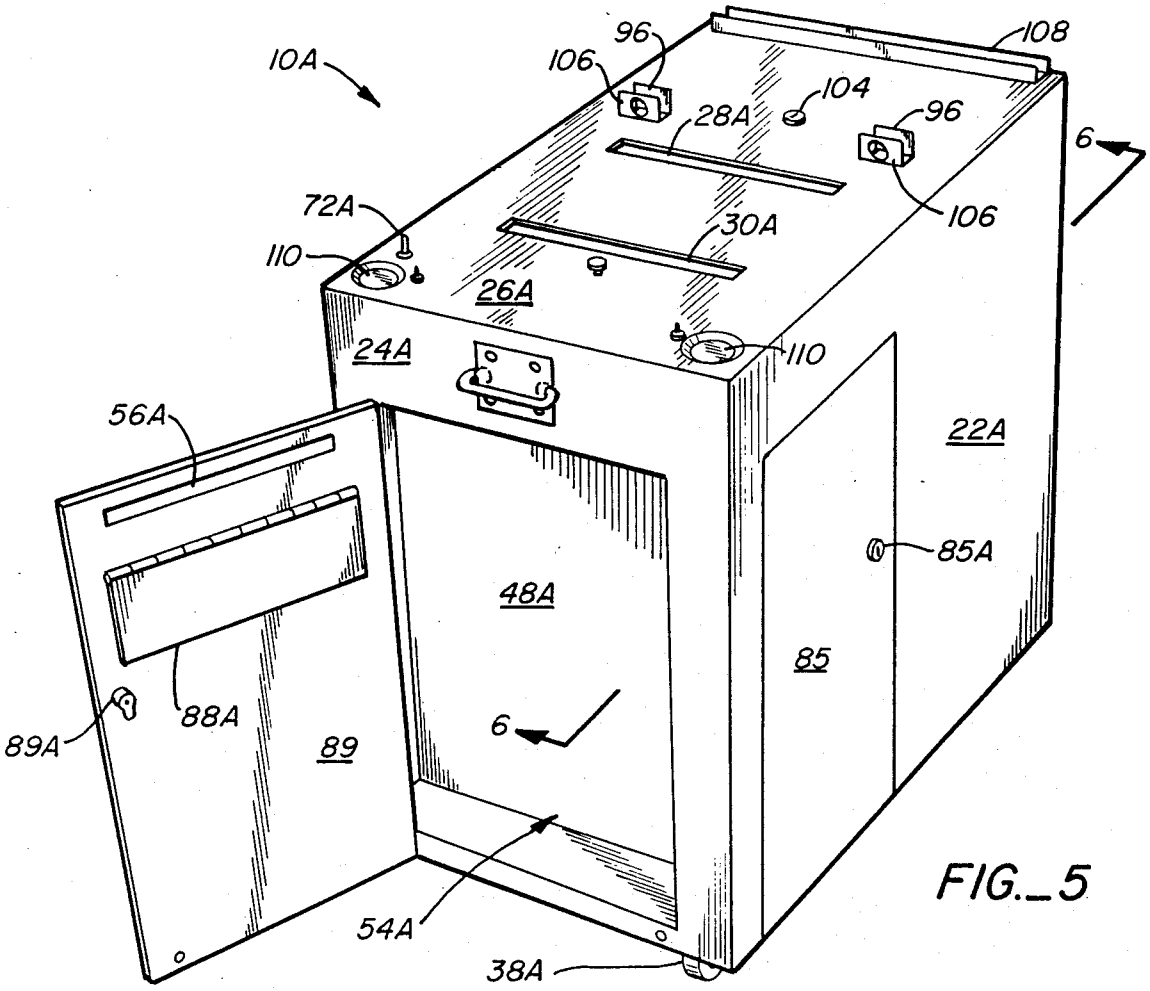
FIG. 5 is a view in perspective of an alternate form of ballot box according to the invention.

An alternate form of ballot box 10 A is provided, as shown in FIGS. 5 and 6, which also embodies features of the present invention. In the ballot box 10A the enclosure is formed in a general oblong shape from sheet metal and has sidewalls 22A, end walls 24A, a top panel 26A and a bottom panel 27A. A series of four wheels 38A are connected to the bottom panel to provide ease of transport. Within the enclosure are provided two fixed dividers 46A and 48A which form internal compartments 50A, 52A and 54A.

On the top panel 26A, a pair of elongated, spaced apart slots 28A and 30A are provided. One slot 28A is located above the large compartment 50A and the other slot 30A is located above the second but somewhat smaller compartment 52A. Another slotted opening 56A is provided for the third smallest compartment 54A. Separate access doors 85, 87 and 89, each with its own lock, are provided for the three compartments. Each of these access doors are provided with their own separate locks 85A, 87A and 89A respectfully. The access door 89 for the smallest compartment has a slot 56A for receiving ballots when the tabulating machine is inoperative. Fixed to the inside of the door 89 is a movable closing flap 88A which can be pivoted upwardly to cover the slot 56A when the tabulating machine is operating normally, thereby preventing any ballots from being placed in compartment 48A inadvertently.

In the embodiment 10A, the slotted openings 28A and 30A can be closed by means of a sliding panel 90 that is mounted underneath the top panel 26A. This panel is supported by the upper ends of the divider partitions 46A and 48A and has a pair of slotted openings 92 and 94 which are substantially the same size and shape as the openings 28A and 30A in the top panel. A pair of upright tab members 96 are attached to the sliding panel and extend upwardly through the top panel so as to be easily accessible. At one end of the sliding panel is a downwardly extending end flange 98 which serves to retain the sliding panel in a predetermined position in cooperation with a rotatable arm 100. The latter is mounted on the lower end of a cylinder 102 which is part of a conventional keyed lock 104 that is fixed in the top panel 26A. As shown in FIG. 6, when the lock 104 is keyed to turn the cylinder and thus the arm 100 away from the end flange 98, the slotted openings 92 and 94 of the sliding panel are aligned with those of the top panel. Conversely, as shown in FIG. 6A, the lock and its arm 100 are turned in the opposite direction the slotted openings 28A and 30A of the top panel are closed and will remain so until the lock and its arm are again turned in the opposite direction.

A mounting stud member 72A is anchored to the top panel which is adapted for connection with a tabulator machine, as with the ballot box 10. A pair of stop members 106 are attached to and extend upwardly from the top panel which serve to retain and position the tabulator machine so that its exit slots register with the openings 28A and 30A in the top panel. At one end of the top panel is an attached channel member 108 and at the other end near the corners of the top panel are a pair of shallow recesses 110. When the ballot boxes 10A are stacked for storage, one set of wheels at one end of an upper ballot box fit within the channel 108 of a lower ballot box while the other set of wheels fit within its recesses 110 thereby maintaining the stacked ballot boxes in stable alignment.

Another important feature of this invention is the dispensation of static electricity which normally builds up in the ballot tabulator 12. On the plastic ballot box 10, the exterior surface of the plastic is sprayed with a commercially available staticide or antistatic material which allows the build up of static in the tabulator to dissipate harmlessly into the ballot box 10. Without this feature the electronics of the tabulator 12 can be effected when a person inserts a ballot or touches the tabulator.

In the metal ballot box 10A the tabulator is grounded by using a commercial spring loaded grounding plunger device on the top of the ballot box and corresponding large flat washers on the outside of the tabulator which are attached to a grounding strap which connects the metal chassis inside the tabulator. These elements are connected inside the tabulator in a conventional manner and are not shown.

As shown in FIG. 5, directly to the right of the stud 72A and inside of the stacking recesses 110 are a pair of spring loaded grounding plungers 111 which are conductively connected to the metal top panel 26A of the ballot box 10A. These plungers serve as grounding contacts for any buildup of static electricity which may occur within the tabulating device 12.

In operation, with both ballot boxes 10 and 10A, the ballot tabulator machine 12 is placed upon the top panel of the ballot box and positioned so that its exit slots are aligned with the ballot box openings to its main compartment or chambers. The tabulator machine is secured in position by the lock stud 72A, as previously described. As the ballots are processed by the tabulator, they are automatically dispensed through one of the openings into the appropriate ballot box compartments. Thus, normal ballots may be accumulated in one compartment and write-in ballots may be accumulated in the other compartment. The procedure for use of the third compartment has already been described above. When the voting process has been completed, the ballot box can be kept locked until it has been transported to a desired location and/or until the box is opened for further disposition of the ballots in accordance with local voting regulations.

To those skilled in the art to which this invention relates, many changes in construction and widely differing embodiments and application of the invention will suggest themselves without departing form the spirit and scope of the invention. The disclosure and the description herein are purely illustrative and are not intended to be in any sense limiting.

What is claimed is:

1. For use in combination with a voter ballot tabulating device which accepts marked paper ballots, tabulates the voter selection thereon and dispenses the tabulated ballots through one of a plurality of exit openings in the bottom of the device, a ballot box comprising:

enclosure means having side walls, end walls, a bottom member and a top member, said top member having at least one pair of parallel, space apart elongated openings;

means on said top member for retaining said ballot tabulating device so that its exit openings are aligned with said elongated openings in said top member;

partition means within said enclosure means for forming separate storage chambers beneath each of said elongated openings for receiving tabulated ballots of different categories; and access means in said enclosure for retrieving ballots collected in said storage chambers.

2. The ballot box as described in claim 1 wherein said retaining means for said tabulating device comprises a stud member mounted on and extending upright from said top member and adapted to connect with said tabulating device.

3. The ballot box as described in claim 1 including an auxiliary chamber at one end of said enclosure for receiving marked ballots if the tabulating device becomes temporarily inoperative, slot means providing an opening into said auxiliary chamber and flap means for covering said slot means when said auxiliary chamber is not being used.

4. The ballot box as described in claim 3 including a separate door to said auxiliary chamber at one end of said enclosure and stop means for holding said flap means in its closed position when said door is closed.

5. The ballot box as described in claim 1 including wheels attached to said enclosure means near its four corners to enable its ease of transport.

6. The ballot box as described in claim 1 wherein said enclosure is formed from a pair of upper and lower housing sections which are separable and nestable when the ballot box is to be stored.

7. The ballot box as described in claim 6 wherein said partition means forming said separate storage chambers of foldable planar members which when extended are upright and transverse to the longitudinal centerline of said housing sections.

8. The ballot box as described in claim 7 including means forming spaced apart grooves in the side walls of said housing section for retaining edge portions of said planar partition members.

9. The ballot box as described in claim 6 wherein said upper and lower housing sections are formed from molded plastic material.

10. The ballot box as described in claim 1 including closure means on said top member for temporarily blocking said elongated openings when said ballot box is being transported.

11. The ballot box as described in claim 1 wherein said enclosure comprises a rigid metal container having substantially an oblong shape.

12. The ballot box as described in claim 10 wherein said closure means comprises a slidable panel member located beneath said top member, and means attached to said top member for locking said closure means in either in open position or a closed position.

13. The ballot box as described in claim 11 wherein said partitions within said enclosure are metal dividers extending between and attached to the interior side walls of the enclosure to form said separate chambers below said elongated openings.

14. The ballot box as described in claim 11 including hinged doors in the side walls of said enclosure to provide access to said separate chambers, and lock means on said access doors.

15. The ballot box as described in claim 11 including a pair of conductive grounding terminals fixed to the top member of said enclosure means and spaced apart by a distance equal to grounding terminals on said tabulating device.

* * * * *